US006030138A

United States Patent [19]

Losier

[11] Patent Number: 6,030,138

[45] Date of Patent: Feb. 29, 2000

[54] MICROPOROUS APPLICATOR

[75] Inventor: Donald P. Losier, Chester, N.J.

[73] Assignee: Colgate-Palmolive Company, New York, N.Y.

[21] Appl. No.: 09/197,875

[22] Filed: Nov. 23, 1998

[51] Int. Cl.[7] ..... B05C 11/00

[52] U.S. Cl. ..... 401/266; 401/196; 401/265

[58] Field of Search ..... 401/202, 266, 401/265, 261, 262, 196, 205, 206

[56] References Cited

U.S. PATENT DOCUMENTS 3,179,972 4/1965 Fillmore ..... 401/202
5,743,441 4/1998 Baudin et al. ..... 401/266 X

FOREIGN PATENT DOCUMENTS 141126 5/1985 European Pat. Off. ..... 401/202
2151741 5/1973 Germany ..... 401/202

*Primary Examiner*—David J. Walczak
*Attorney, Agent, or Firm*—Michael McGreal

[57] ABSTRACT

Microporous sintered polymeric materials can be used as the applicator surface for a dispenser if the material is insert molded to a substantially nonporous, relatively rigid frame. Further, the microporous sintered polymeric material should be flexible and have a thickness of less than about 0.060 inch. By being insert molded to substantially nonporous, the gel or lotion is dispensed at a more central location on the applicator surface preventing edge dispensing which leads to wastage and fouling of the container surface. In addition, by the use of a thinner section of microporous sintered polymeric material bonded to a relatively rigid nonporous frame, there is increased flexibility of the microporous sintered polymeric material but with a higher impact strength. Additionally, there is an increased ease in dispensing due to the decreased thickness of the microporous sintered polymeric material.

20 Claims, 2 Drawing Sheets

MICROPOROUS APPLICATOR

FIELD OF THE INVENTION

This invention relates to the use of sintered microporous materials as the applicator surface for lotions and gels. More particularly, this invention relates to a structure for sintered microporous materials that have a high impact strength and substantially no edge extrusion.

BACKGROUND OF THE INVENTION

It has been proposed to use sintered microporous polymeric materials as the applicator surface for lotion and gel dispensers for more than a decade. However, no products have as yet been marketed using a sintered microporous polymeric material as the applicator surface. There are several reasons. A primary reason is that to date those in the art have been using molded inserts. These are essentially solid pieces with the thinnest part about 0.165 cm or more. These molded inserts are susceptible to breaking upon impact with a solid surface. Also, they deliver product in all directions, including through the edge of the insert.

The inserts are quite fragile since they relatively thin and are made from a sintered porous polymeric material, usually a polyene. As a porous structure is formed in the material the strength of the material decreases. This makes the sintered microporous material susceptible to breaking on impact. Also, due to the random, multidirectional pores, the delivery of a lotion or gel also is from the edges of the applicator surface as well as from the center region. The product that is delivered at the edges generally is not effectively used. In addition it can smear or ooze down the side of the container. This negatively affects the container appearance and can soil the hands of a person using the product.

The latter problem of the delivery of the lotion or gel product flowing from the edges was addressed in European Patent Application 0 775 641 A1. In this patent application a barrier is placed below the insert. The barrier has a central opening so that the only place for flow of product will be through this opening. The lotion or gel then will spread out across the surface. However, there still will be some side surface extrusion. This barrier also will provide some reinforcement to the microporous material.

No publication has addressed the problem of the fragility of the sintered microporous materials. If dispensers are made having these microporous sintered polymeric applicator surfaces, and the dispenser dropped where the microporous sintered polymeric material contacts a hard surface, such as a tile floor, the sintered polymeric material will break. If this application surface breaks, the dispenser is useless. The contained product will flow through the cracks in the surface. It is wasted. However, if the thickness of the sintered porous material is increased to increase strength in an effort to solve this problem, there is an increased cost and an increased resistance to the flow of the lotion or gel through the pores. There is then needed an increased force to dispense that decreases the usefulness of the dispenser. It also deleteriously affects the rheology of the gels and lotions to be dispensed.

There is much prior art directed to the use of these microporous sintered polymeric materials for lotion and gel dispensers. These include U.S. Pat. No. 5,018,894; U.S. Pat. No. 5,073,057, U.S. Pat. No. 5,567,073 and European Patent 0 732 273 B1. Each of these patents discloses the use of Porex® microporous sintered polymeric materials as an applicator surface. These are described in various shapes and structures. However, they are all directed to the use of molded inserts that are fitted into the top of the applicator surface. They have the above discussed problems. None have disclosed or suggested a solution to these problems.

BRIEF SUMMARY OF THE INVENTION

This invention relates to a microporous applicator surface for lotions and gels where there is precluded any edge extrusion of product and the surface of the applicator surface has a sufficiently high impact strength that it can survive at least a three foot fall onto a tile floor. This simulates a fall from a bathroom countertop to the floor.

The present invention solves the two problems of undirected flow at the edges of the microporous applicator surface and the low impact strength of the microporous sintered polymeric materials. In the prior art these applicator inserts formed from these materials are fully constructed from the microporous sintered polymeric materials. An outer support region is thicker than an inner region. The microporous sintered polymeric material must provide all of the strength. It has been found that the impact strength problem and the undirected flow problem can be solved simultaneously through the use of a relatively thin sheet of microporous sintered polymeric material that is insert molded to a nonporous relatively rigid frame. The frame will be a material similar to that of the microporous sintered polymeric material, but as noted, will be substantially nonporous. It will have a relatively high strength. Usually both will be polyenes. The microporous sintered polymeric material will be flexible and will have a thickness of less than about 0.15 cm, and preferably less than about 0.13 cm. The use of a nonporous frame provides support for the microporous sintered polymeric material and the flexibility of this material prevents fracture upon impact with a surface.

These improvements are achieved by insert molding a microporous sintered polymeric material onto a relatively rigid plastic frame. The frame is substantially nonporous. It also is a material which is similar to that of the microporous sintered polymeric material. Further, the microporous sintered polymeric material is relatively flexible having a thickness of less than about 0.15 cm and most preferably, less than about 0.13 cm. This applicator surface unit is mounted into a dispenser such as that of copending U.S. patent application Ser. No. 09/233,807 entitled "Cosmetic Dispenser" filed Nov. 4, 1998. Other dispensers also can be used. The key feature is the use of a relatively flexible microporous sintered polymeric material insert molded to a relatively rigid frame. The relatively rigid frame provides structural integrity and precludes flow from the edge of the applicator surface.

DETAILED DESCRIPTION OF THE INVENTION

The solution to prevent the edge extrusion of gel and lotion products through microporous sintered polymeric materials, such as Porex® materials, and a structure to increase the strength of these materials during use will be described in more detail. These materials have a random array of interconnected pores of varied and nonuniform cross-sectional thickness. The gel or lotion to be dispensed must traverse these pores. The randomness of the pores deliver the lotions and gels in all directions. This includes through the edges of the applicator surface. A high porosity for ease of delivery decreases the impact strength of the material. This makes the applicator surface susceptible to fracture upon impact with another surface.

Figure 1:
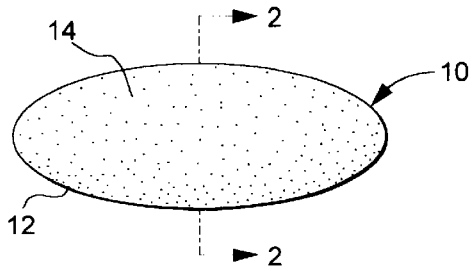
FIG. 1 (PRIOR ART)
FIG. 1 is a top plan view of a microporous sintered polymeric material applicator insert for a dispenser.
Figure 2:
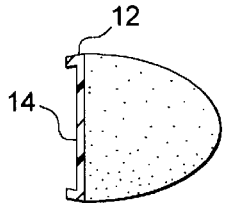
FIG. 2 (PRIOR ART)
FIG. 2 is a cross-sectional view of the insert of FIG. 1 along line 2—2.

In FIGS. 1 and 2 there is shown a prior art type applicator insert 10 that is constructed entirely of a microporous sintered polymeric material. This includes the edge area 12 and the center area 14. Product can flow through edge area 12 as well as through center area 14.

In FIGS. 3 to 6 there is shown the insert 20 of the present invention and its use on a deodorant dispenser.

Figure 3:
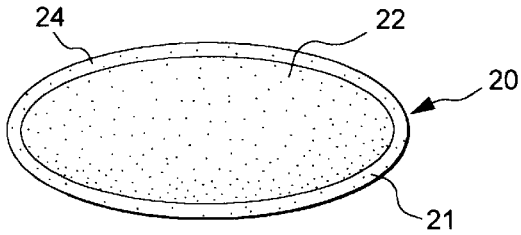
FIG. 3 is a top plan view of an applicator insert with a relatively rigid nonporous frame.
Figure 4:
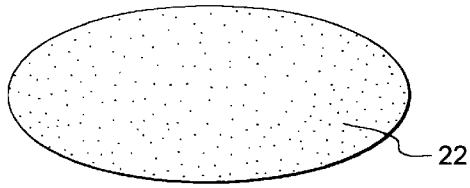
FIG. 4 is a perspective view of a microporous sintered polymeric material to be bonded to the relatively rigid frame.

In FIG. 3 there is shown the relatively rigid substantially nonporous frame 21. The sheet of microporous sintered polymeric material 22 is attached to the relatively rigid, substantially nonporous frame by insert molding to produce the unit shown in cross-section in FIG. 5. Since the frame is nonporous the microporous material 24 above the frame 21 does not transport any substantial amount of gel or lotion. Also, the material 24 above the frame since it has been insert molded to the frame has a significantly reduced pore structure. The insert molding process will collapse most of pores of the microporous material with the delivery of product primarily being through the more central part of the applicator surface.

Figure 5:
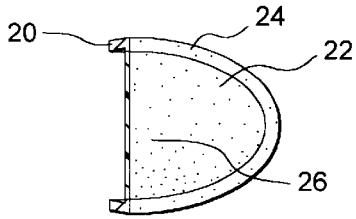
FIG. 5 is a cross-sectional view of the microporous sintered polymeric material of FIG. 4 bonded to the frame of FIG. 3.

FIG. 5 shows the applicator in cross-section with frame 21 supporting microporous sintered polymeric material 22. The relatively rigid frame supports the more flexible microporous sintered polymeric material 22. This microporous sintered polymeric material preferably in the center region 26 is of a thickness of less than about 0.15 cm. The thinner material has increased flex and thus a higher impact strength. Also, the relatively rigid frame increases the strength of the edge of the microporous sintered polymeric material. The frame 21 can be of any polymer material that can be insert molded to the microporous sintered polymeric material. Usually the frame will be the same material as the microporous sintered polymeric material. Since the Porex® materials are polyenes such as polyethylenes and polypropylenes, the frame will be a similar polyene.

Figure 6:
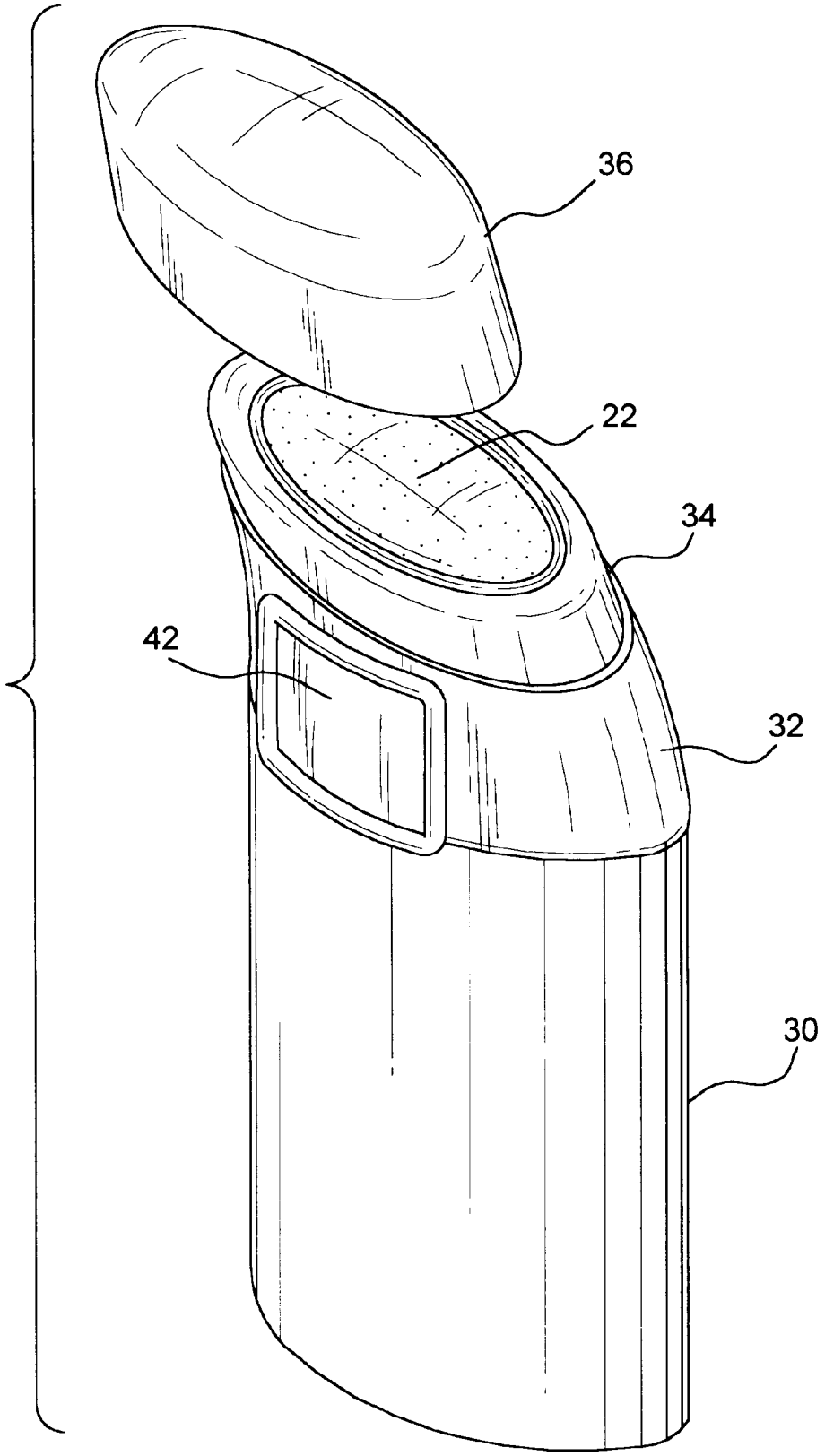
FIG. 6 is a perspective view of the microporous sintered polymeric material as a part of a dispenser.

FIG. 6 shows the insert applicator of FIG. 5 as a part of a dispenser. This is comprised of barrel 30 with barrel extension 32 and an upper end.

On an upper end of the barrel extension is applicator 34 which has the insert 20 of the present invention. The dispenser is closed by cap 36. This dispenser has an actuator 42 on an upper part of the dispenser and is angled for ease of use. However, the dispenser can be of essentially any shape. It only is necessary that the applicator insert of the present invention be used as a surface for applying a lotion or gel to a body surface. The dispenser is activated by depressing button 42. This causes a gel or lotion to pass onto the surface of microporous material 22.

The microporous materials can be any plastic with a microporous structure. Preferred materials are the Porex® microporous plastics produced by the Porex® Technologies Corporation in Fairburn, Ga. These are microporous, sintered polyene, usually a polyethylene. However, they also can be a polypropylene. The Porex® microporous materials are made by molding together plastic microspheres. The porosity is dependent on the size of the microspheres and the particular molding technique. Techniques for making microporous materials are described in U.S. Pat. No. 3,051,993, U.S. Pat. No. 4,761,232 and U.S. Pat. No. 5,432,100. The techniques described in these patents for making macroporous and microporous materials are incorporated herein by reference.

Insert molding is a process where the frame is formed by injection molding the frame with the sintered, microporous material present in the mold. The material of the frame is a material that can be heat bonded to the sintered, microporous material. For this reason the frame will be a polyene when the sintered, microporous material is a polyene. Preferably the same polyene material will be used for the frame and the sintered, microporous material. This material in many instances will be polyethylene or polypropylene. With the sintered, microporous material in the mold, the hot plastic of the frame is injected into the mold. The heat of this plastic melts or softens the plastic at the edge of the sintered, microporous material and bonds to the sintered, microporous material.

What is claimed is:

1. A microporous applicator comprising a microporous sintered polymeric material molded to a substantially nonporous frame said substantially nonporous frame being the sole support for said microporous sintered polymeric material, said microporous sintered polymeric material having a thickness of less than about 0.15 cm whereby product dispensed through said applicator does not dispense through the peripheral edge of the applicator and said applicator when a part of a dispenser will not be fractured when dropped from a height of three feet onto a ceramic surface.

2. A microporous applicator as in claim 1 wherein said microporous sintered polymeric material has a thickness of less than about 0.13 cm.

3. A microporous applicator as in claim 1 wherein the material of said microporous sintered polymeric material and said frame are polyenes.

4. A microporous applicator as in claim 3 wherein said polyene is selected from the group consisting of polyethylene and polypropylene.

5. A microporous applicator as in claim 4 wherein said frame and said microporous sintered polymeric material are the same polyene.

6. A microporous applicator as in claim 1 wherein said frame is oval in shape.

7. A microporous applicator as in claim 1 wherein said frame is circular in shape.

8. A dispenser comprising a barrel, a product holder in said barrel, a means in said barrel to elevate the product holder from a lower part of said barrel to an upper part of said barrel, and a microporous applicator closing the upper part of said barrel, said microporous applicator comprising a microporous sintered polymeric material molded to a substantially nonporous frame, said substantially nonporous frame being the sole support for said microporous sintered polymeric material said microporous sintered polymeric material having a thickness of less than about 0.15 cm whereby product dispensed through said applicator does not dispense through the peripheral edge of the applicator and said applicator of said dispenser will not be fractured when dropped three feet onto a ceramic surface.

9. A microporous applicator as in claim 8 wherein said microporous sintered polymeric material has a thickness of less than about 0.13 cm.

10. A microporous applicator as in claim 8 wherein the material said microporous sintered polymeric material and said frame are polyenes.

11. A microporous applicator as in claim 10 wherein said polyene is selected from the group consisting of polyethylene and polypropylene.

12. A microporous applicator as in claim 11 wherein said frame and said microporous sintered polymeric material are the same polyene.

13. A microporous applicator as in claim 8 wherein said frame is oval in shape.

14. A microporous applicator as in claim 8 wherein said frame is circular in shape.

15. A micro porous applicator comprising a microporous sintered polymeric material insert injection molded to a substantially nonporous frame said substantially nonporous frame being the support for said microporous sintered polymeric material, said microporous sintered polymeric material having a thickness of less than about 0.15 cm whereby product dispensed through said applicator does not dispense through the peripheral edge of the applicator and said applicator when a part of a dispenser will not be fractured when dropped from a height of three feet onto a ceramic surface.

16. A microporous applicator as in claim 15 wherein said microporous sintered polymeric material has a thickness of less than about 0.13 cm.

17. A microporous applicator as in claim 15 wherein said microporous sintered polymeric materials and said frame are polyenes.

18. A microporous applicator as in claim 17 wherein said polyene is selected from the group consisting of polyethylene and polypropylene.

19. A microporous applicator as in claim 18 wherein said frame and said microporous sintered polymeric material are the same polyene.

20. A microporous applicator as in claim 15 wherein said frame is oval in shape.

* * * * *